US009488127B2

(12) United States Patent
Beyer et al.

(10) Patent No.: US 9,488,127 B2
(45) Date of Patent: Nov. 8, 2016

(54) BORE BRIDGE AND CYLINDER COOLING

(71) Applicant: Ford Global Technologies, LLC, Dearborn, MI (US)

(72) Inventors: Theodore Beyer, Canton, MI (US); Jody Michael Slike, Farmington Hills, MI (US); Jeffrey D. Fluharty, Woodhaven, MI (US); John Christopher Riegger, Ann Arbor, MI (US); Scott Eeley, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 81 days.

(21) Appl. No.: 14/254,372

(22) Filed: Apr. 16, 2014

(65) Prior Publication Data

US 2015/0300236 A1 Oct. 22, 2015

(51) Int. Cl.
*F02F 1/14* (2006.01)
*F02F 1/10* (2006.01)

(52) U.S. Cl.
CPC *F02F 1/14* (2013.01); *F02F 1/108* (2013.01)

(58) Field of Classification Search
CPC ..... F01P 3/02; F02F 2001/104; F02F 1/108
See application file for complete search history.

(56) References Cited

U.S. PATENT DOCUMENTS

| | | | | |
|---|---|---|---|---|
| 4,083,570 | A | 4/1978 | Sugawara | |
| 5,853,175 | A | 12/1998 | Udagawa | |
| 6,901,891 | B2 * | 6/2005 | Suzuki et al. | 123/41.79 |
| 7,278,381 | B2 * | 10/2007 | Matsutani et al. | 123/41.74 |
| 2010/0326380 | A1 * | 12/2010 | Fedeson et al. | 123/41.82 R |
| 2011/0023799 | A1 | 2/2011 | Lenz et al. | |
| 2012/0031354 | A1 * | 2/2012 | Beyer et al. | 123/41.79 |
| 2014/0331947 | A1 * | 11/2014 | Beyer et al. | 123/41.74 |

* cited by examiner

*Primary Examiner* — Lindsay Low
*Assistant Examiner* — Kevin Lathers
(74) *Attorney, Agent, or Firm* — Brooks Kushman P.C.; Greg P. Brown

(57) ABSTRACT

An internal combustion engine includes a head gasket positioned between a cylinder block and a cylinder head. The cylinder block has first and second cylinders separated by a block bore bridge, and a block cooling jacket with a first passage and a second passage intersecting a block deck face. The cylinder head has first and second chambers separated by a head bore bridge, and a head cooling jacket with a third passage and a fourth passage intersecting a head deck face. The gasket forms a slot positioned adjacent to at least one of the block bore bridge and the head bore bridge to fluidly connect the first and fourth passages to cool the at least one of the block bore bridge and head bore bridge.

18 Claims, 5 Drawing Sheets

BORE BRIDGE AND CYLINDER COOLING

TECHNICAL FIELD

Various embodiments relate to cooling passages for a bore bridge between two cylinders in an internal combustion engine.

BACKGROUND

In water-cooled engine cylinder head design, sufficient cooling may need to be provided to the bore bridge between adjacent engine cylinders. The bore bridge on the cylinder block and/or the cylinder head is a stressed area with little packaging space. Beads on a head gasket surrounding each cylinder are close to one another along the bore bridge, and stresses from one bead may translate to the bead of a neighboring cylinder, which may also reduce fatigue strength of the gasket. In small, high output engines, the packaging, thermal stress, and mechanical stress may be increased. The high temperatures and stress in this area may reduce fatigue strength of the surrounding components. Additionally, high temperatures at the bore bridge may increase valve seat distortion, which in turn may lead to biased wear, valve leaks, rough engine idling, and/or reduced engine power output.

SUMMARY

In an embodiment, an internal combustion engine is provided with a cylinder block, a cylinder head, and a head gasket. The cylinder block defines a block deck face, first and second cylinders, and a block cooling jacket. The first and second cylinders are adjacent to one another and separated by a block bore bridge. The cylinder head has a head deck face defining first and second chambers, and a head cooling jacket. The first and second chambers are adjacent to one another and are separated by a head bore bridge. The first chamber and the first cylinder form a first combustion chamber. The second chamber and the second cylinder form a second combustion chamber. The head gasket is interposed between the cylinder block and the cylinder head, and has a block side and a head side. The block cooling jacket has a first passage and a second passage intersecting the block deck face on either side of the block bore bridge. The head cooling jacket has a third passage and a fourth passage intersecting the head deck face on either side of the head deck face. The head gasket forms a slot positioned adjacent to at least one of the block bore bridge and the head bore bridge to fluidly connect the first and fourth passages such that coolant flows from the first passage along at least one of the block deck face and the head deck face and to the fourth passage to cool the associated bore bridge.

In another embodiment, a head gasket for an engine having a cooling jacket is provided. A generally planar gasket body has an upper layer for cooperation with a cylinder head deck face, a lower layer for cooperation with a cylinder block deck face, and an intermediate layer positioned between the upper and lower layers. The gasket has formed therein a slot formed by the upper, lower, and intermediate layers of the gasket body and adjacent to at least one of a cylinder head bore bridge and a cylinder block bore bridge. The lower layer forms an inlet region adjacent to an upstream cooling passage in a cylinder block. The upper layer forms an outlet region adjacent to a downstream cooling passage in the cylinder head. The intermediate layer forms a channel connecting the inlet and outlet regions. The inlet and outlet region are spaced apart transversely on the gasket.

In yet another embodiment, an engine is provided with a cylinder block having a first cooling passage intersecting a block deck face, a cylinder head having a second cooling passage intersecting a head deck face, and a head gasket. The first and second passages are on opposed sides of a bore bridge formed between adjacent cylinders. The head gasket is placed between the block and the head. The head gasket defines a slot connecting the first and second passages.

Various embodiments of the present disclosure have associated, non-limiting advantages. The head side and/or block side of the gasket may be slit to provide a slot between adjacent gasket beads. The slot may run from the intake to the exhaust side of the bore bridge, or vice versa. A corresponding saw cut may also be provided in the cylinder head and/or cylinder block to form a cooling passage with the associated slot. By providing a slit in one or more layers of the gasket, an interaction load of a neighboring cylinder may be reduced or eliminated. A bead on the gasket may be allowed to "breathe" and increase gasket durability. The slot and associated saw cut may promote pressure driven flow across the deck face and along the bore bridge, either from the intake to exhaust side or vice versa. The coolant flow across the bore bridge reduces head gasket and cylinder head temperatures at the bridge. Additionally, a saw cut in the cylinder head allows the head to expand as temperatures increase during engine operation to reduce stress on the chamber, which in turn may reduce distortion of valve seats. As the valve seats expand due to heating, the saw cut may provide for sufficient load weakening of the bore bridge to allow the valve seat to remain generally round. Without a saw cut and bore bridge cooling, the valve seat may become distorted with heating because of the constrained geometry, i.e. egg shaped, which may reduce durability, valve sealing, and the like. The saw cut may be spaced apart from one of the cooling passages and connected to the other cooling passage to provide structure for the deck face. The depth of the saw cut may vary, and a deeper saw cut provides for additional structural flexibility and reduced valve distortion.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
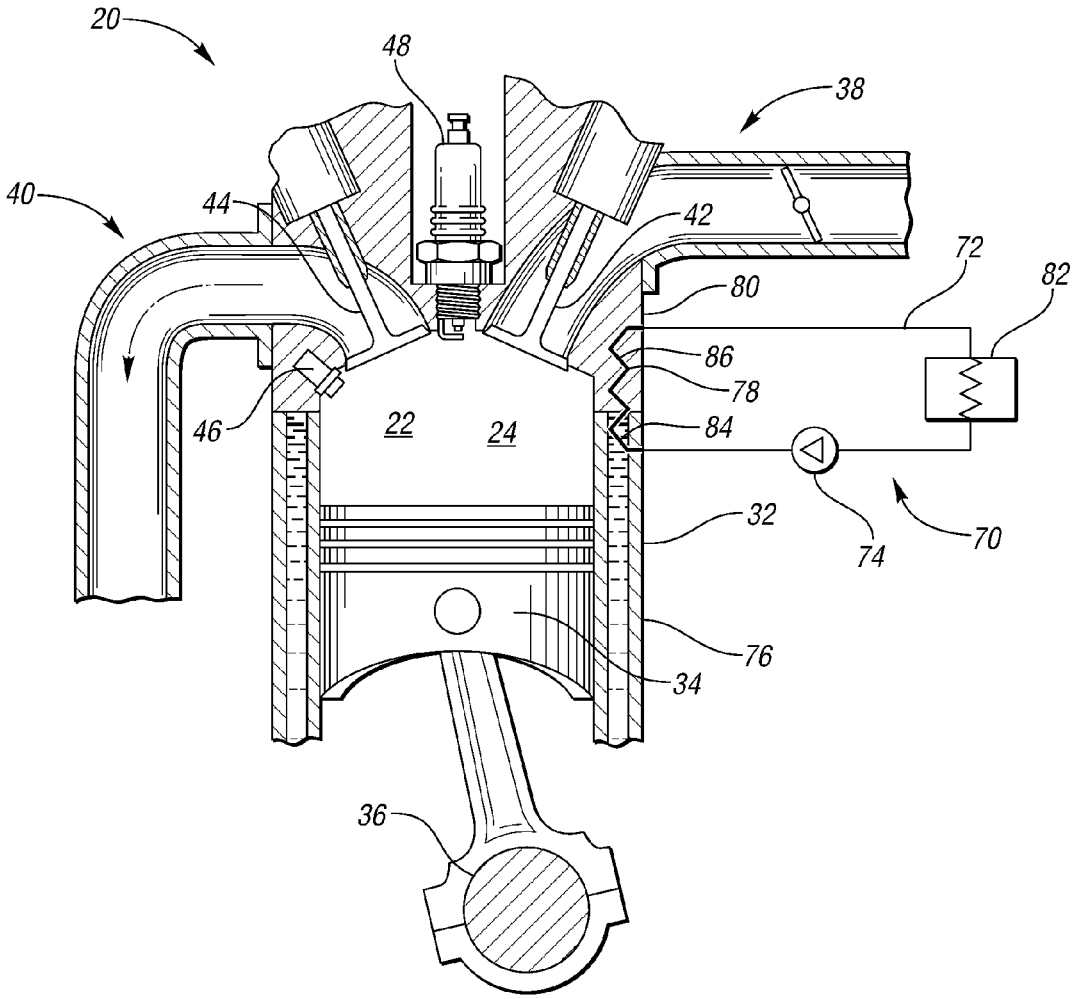
FIG. 1 illustrates a schematic of an engine configured to implement the disclosed embodiments.

FIG. 1 illustrates a schematic of an internal combustion engine 20. The engine 20 has a plurality of cylinders 22, and one cylinder is illustrated. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 30. An exhaust valve 44 controls flow from the combustion chamber 30 to the exhaust manifold 40. The intake and exhaust valves 42, 44 may be operated in various ways as is known in the art to control the engine operation.

A fuel injector 46 delivers fuel from a fuel system directly into the combustion chamber 30 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 30. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 includes a cooling system 70 to remove heat from the engine 20. The amount of heat removed from the engine 20 may be controlled by a cooling system controller or the engine controller. The cooling system 70 may be integrated into the engine 20 as a cooling jacket. The cooling system 70 has one or more cooling circuits 72 that may contain water or another coolant as the working fluid. In one example, the cooling circuit 72 has a first cooling jacket 84 in the cylinder block 76 and a second cooling jacket 86 in the cylinder head 80 with the jackets 84, 86 in fluid communication with each other. The block 76 and the head 80 may have additional cooling jackets. Coolant, such as water, in the cooling circuit 72 and jackets 84, 86 flows from an area of high pressure towards an area of lower pressure.

The cooling system 70 has one or more pumps 74 that provide fluid in the circuit 72 to cooling passages in the cylinder block 76. The cooling system 70 may also include valves (not shown) to control to flow or pressure of coolant, or direct coolant within the system 70. The cooling passages in the cylinder block 76 may be adjacent to one or more of the combustion chambers 24 and cylinders 22, and the bore bridges formed between the cylinders 22. Similarly, the cooling passages in the cylinder head 80 may be adjacent to one or more of the combustion chambers 24 and cylinders 22, and the bore bridges formed between the combustion chambers 24. The cylinder head 80 is connected to the cylinder block 76 to form the cylinders 22 and combustion chambers 24. A head gasket 78 in interposed between the cylinder block 76 and the cylinder head 80 to seal the cylinders 22. The gasket 78 may also have a slot, apertures, or the like to fluidly connect the jackets 84, 86. Coolant flows from the cylinder head 80 and out of the engine 20 to a radiator 82 or other heat exchanger where heat is transferred from the coolant to the environment.

Figure 2:
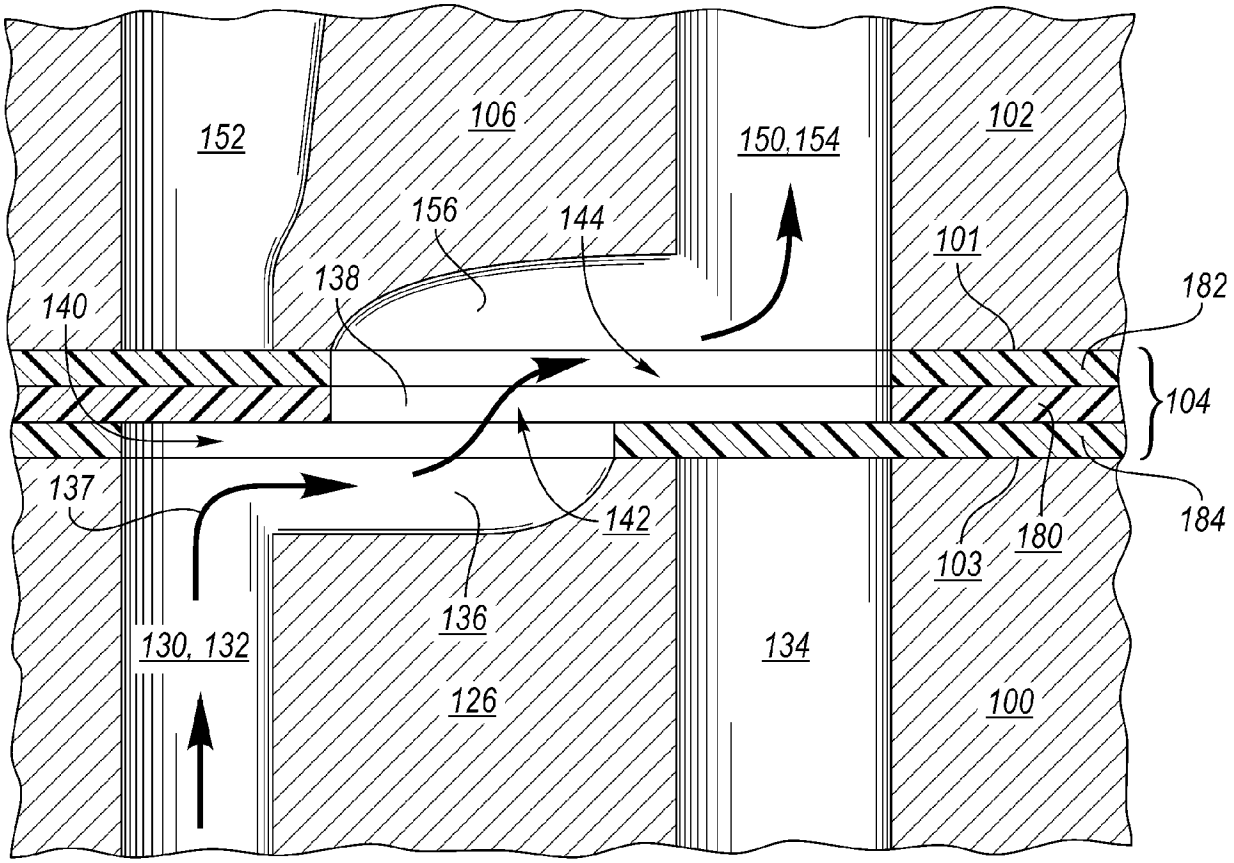
FIG. 2 illustrates a schematic of cooling paths for a cooling jacket of the engine of FIG. 1 according to an embodiment.
Figure 3:
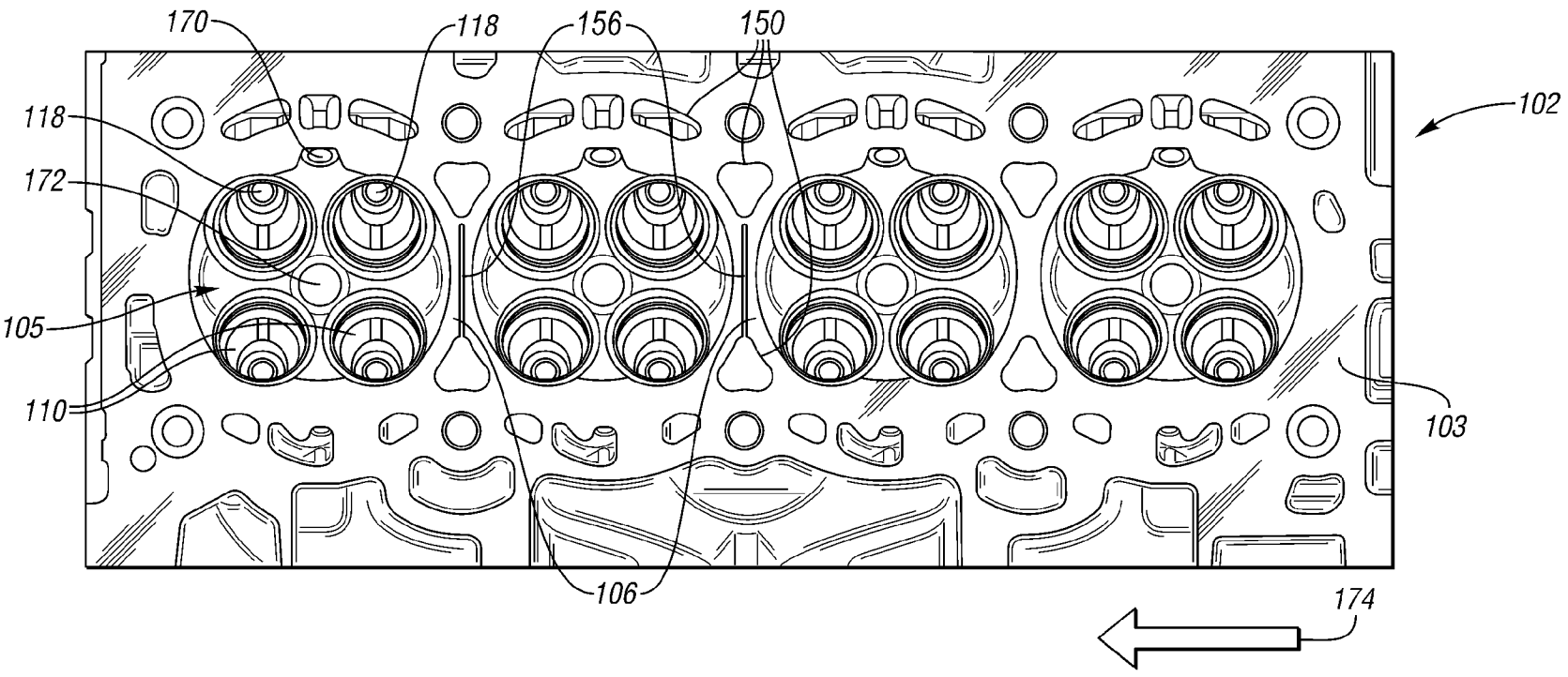
FIG. 3 illustrates a perspective view of a cylinder head according to an embodiment.
Figure 4:
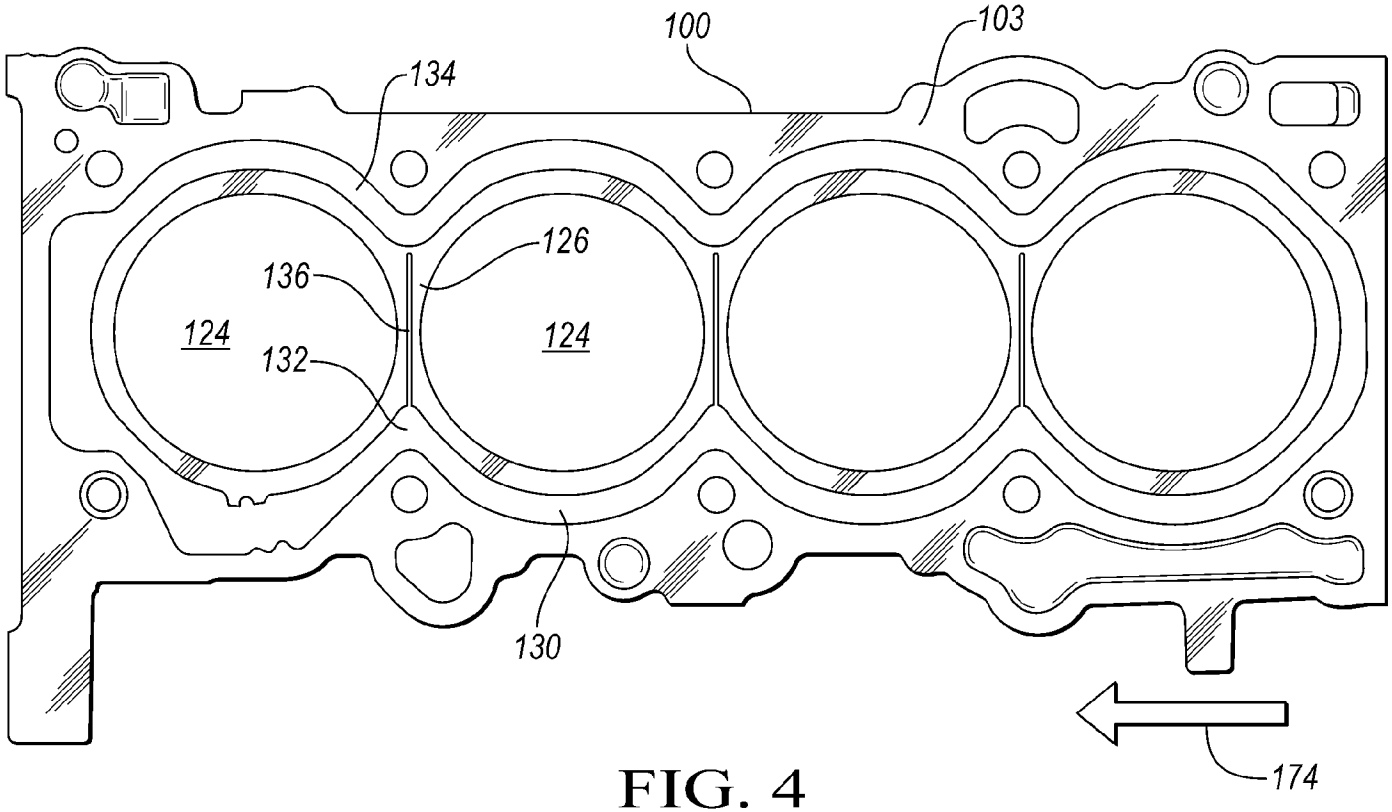
FIG. 4 illustrates a perspective view of a cylinder block according to an embodiment.
Figure 5:
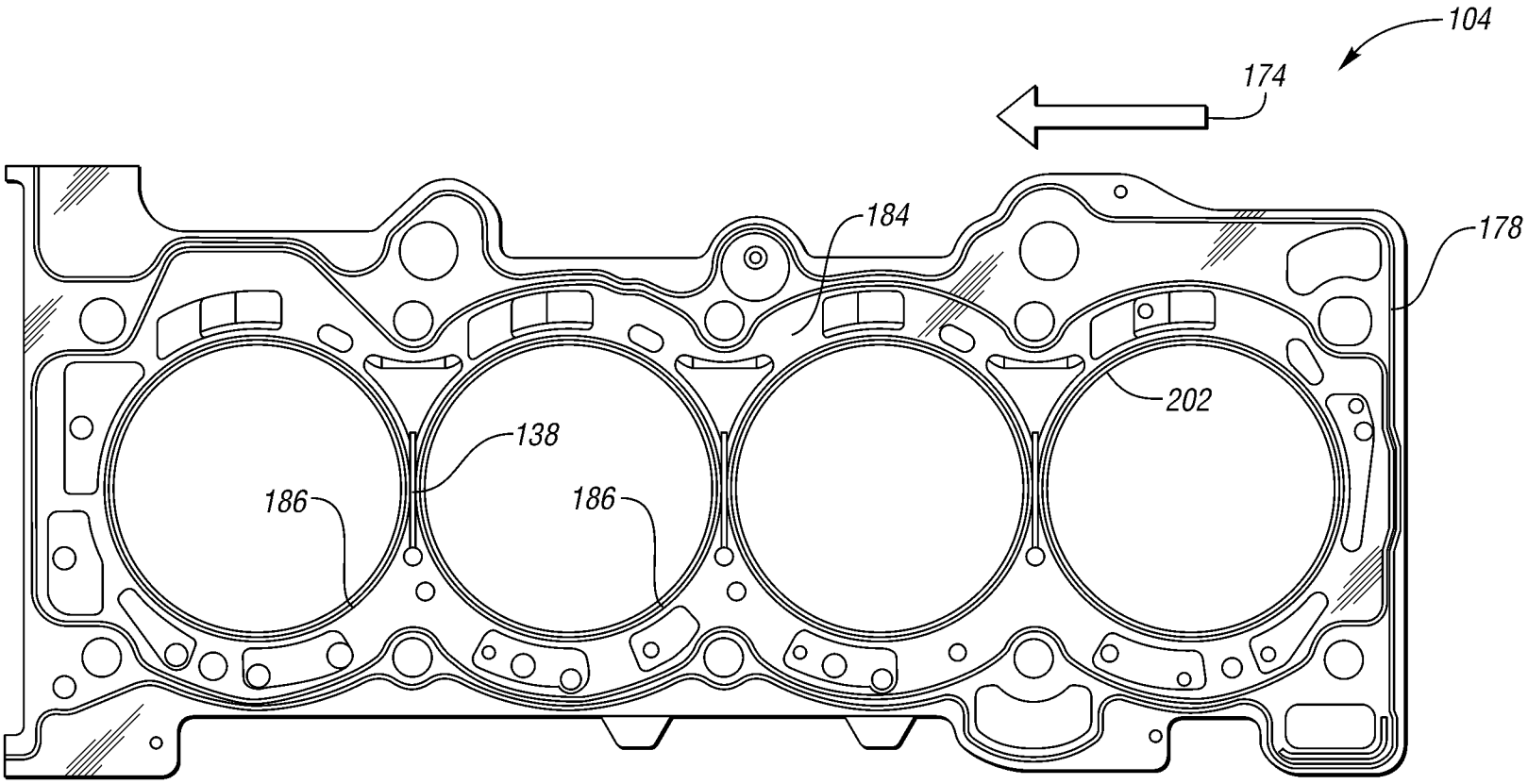
FIG. 5 illustrates a perspective view of a head gasket for use with the cylinder block of FIG. 3 and/or the cylinder head of FIG. 4 according to an embodiment.

FIGS. 2-4 illustrate an example of the present disclosure. FIG. 2 illustrates a schematic of fluid flow across a bore bridge according an example of the present disclosure. FIG. 3 illustrates the cylinder head. FIG. 4 illustrates the cylinder block. FIG. 5 illustrates the head gasket.

The cooling system of FIG. 2 may be implemented on the engine illustrated in FIG. 1. FIG. 2 illustrates cooling paths across both the cylinder head bore bridge and the cylinder block bore bridge, and in other embodiments, a cooling path may be present across only the cylinder head bore bridge or the cylinder block bore bridge based on the gasket design. The cylinder block 100 of the engine is connected to the cylinder head 102 using a head gasket 104 to form a combustion chamber in the engine. The deck face 101 of the cylinder block 100 and the deck face 103 of the cylinder head 102 are in contact with first and second opposed sides of the gasket 104.

Between adjacent chambers 105 in the cylinder head 102 are bore bridges 106. The cylinder head 102 may have a pair of exhaust valves 108 in each chamber 105. The exhaust valves 108 are located in exhaust ports 110 in the cylinder head 102 and are seated on valve seats 112.

The cylinder head 102 has a pair of intake valves 116. The intake valves 116 are located in intake ports 118 in the cylinder head 102 and are seated on valve seats 120. The cylinder head 102 also has a spark plug 122.

Between adjacent cylinders 124 in the block 100 are bore bridges 126. The chambers 105 and the cylinders 124 cooperate to form combustion chambers for the engine. The gasket 104 may include a bead on each side of the gasket and surrounding the chambers 105 and cylinders 124 to help seal the combustion chambers of the engine.

Coolant in the block cooling jacket 130 flows from a passage 132 on the intake side, across bore bridge 126 and/or bore bridge 106, and to a passage 154 in the cooling jacket 150 on the exhaust side of the cylinder head 102. The passage 154 is at a lower pressure than passage 132. The bore bridge 126 may include a saw cut 136, or slot, in the deck face 101. The saw cut 136 may be connected to the passage 132 and spaced apart from an exhaust side passage 134 in the jacket 130. The saw cut 136 may be a machined groove. The saw cut 136 may be cut deeper on the intake side and cut shallower on the exhaust side, such that the depth decreases. The saw cut 136 may include a radius of curvature as the depth increases to provide an improved flow of coolant through and across the bore bridge 126 and increased heat transfer. The gasket 104 may have one or more layers removed from the block side of the gasket 104 to provide a coolant flow path 137. The gasket 104 may form a slot 138 with an inlet region 140, a channel 142, and an outlet region 144. As shown in FIG. 2, the slot 138 may be inclined across the gasket as layers are removed in a step wise or staggered manner to fluidly connect passages 132, 154 and fluidly disconnect passages 134, 152 with the slot 138. In other embodiments, the coolant may flow in the opposite direction, i.e. from the exhaust side to the intake side, and the saw cut may be reversed.

Coolant flow to the head cooling jacket 150 from the passage 132 on the intake side of the block 100, across the bore bridge 106, and to a passage 154 in the cooling jacket 150 on the exhaust side of the cylinder head 102. The passage 154 is at a lower pressure than passage 132. The bore bridge 106 may include a saw cut 156, or slot, in the deck face 103. The jacket 150 may also have a passage 152 on the intake side. The saw cut 156 may be spaced apart from the passage 152 and extend to and be connected to the passage 154. The saw cut 156 may be a machined groove. The saw cut 156 may be cut shallow on the intake side and cut deeper on the exhaust side, such that the depth increases. The saw cut 156 may include a radius of curvature as the depth increases to provide an improved flow of coolant through and across the bore bridge and increased heat transfer. The gasket 104 may have one or more layers removed from the head side of the gasket 104 to provide the coolant flow path 137.

Coolant flow through the engine is generally shown by the arrows in FIG. 2. The gasket 104 may provide a coolant flow path 137 from the block 100 to the head 102 across one or both of the bore bridges 126, 106. The gasket 104 may provide a barrier at passages 134 or 152, thereby causing the coolant to flow transversely from an intake side to an exhaust side of the engine across the bore bridges.

FIG. 3 illustrates a partial bottom perspective view of a cylinder head 102 employing an embodiment of the present disclosure. The cylinder head 102 may be cast out of a suitable material such as aluminum. The cylinder head 102 is a component in an in-line four cylinder engine, although other engine configurations may also be used with the present disclosure. The cylinder head 102 has a deck face 103 or bottom face that forms chambers 105. Each chamber 105 cooperates with a corresponding cylinder 124 in a cylinder block to form a combustion chamber. Each chamber 105 has a pair of intake ports 118 sized to receive intake valve seats and intake valves. Each chamber 105 also has a pair of exhaust ports 110 sized to receive exhaust valve seats and exhaust valves. A port 170 is provided for an injector, and another port 172 is provided for a spark plug. Various passages are also provided on the deck face 103 and within the cylinder head 102 that form a cooling jacket 150 for the cylinder head and engine. The cooling jacket 150 may cooperate with corresponding ports on the cylinder block to form a cooling jacket for the engine. Coolant in the cylinder head passages in the block deck face may travel along a longitudinal axis 174 or longitudinal direction of the engine such that coolant is provided to the cylinders in a sequential manner.

A bore bridge 106 is formed between a pair of chambers 105. The bore bridge 106 may require cooling with engine operation as the temperature of the bridge 106 may increase due to conduction heating from hot exhaust gases in the combustion chamber. The bore bridge 106 may be provided with a saw cut 156.

FIG. 4 illustrates a partial top perspective view of a cylinder block 100 employing an embodiment of the present disclosure. The cylinder block 100 may be cast out of a suitable material such as aluminum. The cylinder block 100 is a component in an in-line four cylinder engine, although other engine configurations may also be used with the present disclosure. The cylinder block 100 has a deck face 101 or top face that forms cylinders 124. Each cylinder 124 cooperates with a corresponding chamber 105 in the head 102 to form the combustion chamber. Each cylinder 124 has an exhaust side that corresponds to the side of the head with the exhaust ports, and an intake side that corresponds to the side of the head with the intake ports. Various passages are also provided on the deck face 103 and within the cylinder block 100 that form a cooling jacket 130 for the cylinder block and engine. The cooling jacket 130 may cooperate with corresponding ports on the cylinder head to form a cooling jacket for the engine. Coolant in the cylinder block passages in the block deck face may travel along a longitudinal axis 174 or longitudinal direction of the engine such that coolant is provided to the cylinders in a sequential manner.

A bore bridge 126 is formed between a pair of cylinders 124. The bore bridge 126 may require cooling with engine operation as the temperature of the bridge 126 may increase due to conduction heating from hot exhaust gases in the combustion chamber. The bore bridge 126 may be provided with a saw cut 136.

FIG. 5 illustrates a head gasket 104 that cooperates with the cylinder head 102 of FIG. 3 and the cylinder block of FIG. 4 to form the cylinders of the engine and the cooling paths as shown in FIG. 2. Coolant in the cooling system may flow across the gasket 104 to cool the cylinder block bore bridges and/or the cylinder head bore bridges. The gasket 104 has a generally planar gasket body 178 that defines various apertures corresponding to bolt holes or other components of the engine. The gasket 104 also has slots 138 to form cooling passages. The slot 138 may cooperate with the saw cut 136, 156 as shown in FIG. 2 to form a cooling path between the passages 132, 154. In one example, the gasket 104 is constructed from multiple layers, and each layer may be made from steel or another suitable material. One or more center layers 180 may be used as a spacer, and it may assist in determining the gasket thickness as well as provide a separating layer. The gasket has at least one upper layer 182 on the head side of the gasket 104. The layer 182 is formed with a slot or slit next to the saw cut 156 and bore bridge 106 of the head 102. The gasket 104 also has at least one lower layer 184 on the block side of the gasket. The layer 184 is formed with a slot or slit next to the saw cut 136 and bore bridge 126 of the block 100. The slots 138, 158 may be formed by stamping the outer layers and center layers of the gasket, or by another process as is known in the art. As can be seen in FIG. 5, each slot lies between beads 186 of the gasket. The slots 138 may be formed by selectively removing gasket material from one or more layers to form a coolant path from the block to the head across one or more bore bridges. Slots may be provided in each layer of the gasket that cooperate to form the coolant path across the gasket, and slots in different layers may be the same length, different lengths, and may be aligned or offset to provide the desired coolant flow pattern. As can be seen in FIG. 2, a slot in the head side layer is offset from a slot in the block side layer.

As can be seen in FIGS. 3 and 4, the upstream passage 132 may be a print such that it has a generally triangular shape or other appropriate shape where the passage intersects the respective deck face. The downstream passage 154 may also be a print such that it has a generally triangular shape or other appropriate shape where the passage intersects the respective deck face. In other embodiments, the upstream and/or downstream passages may be a drill with a circular cross section.

The gasket body 178 has an upper layer 182 for cooperation with a cylinder head deck face 103, a lower layer 184 for cooperation with a cylinder block deck face 101, and an intermediate layer 180 positioned between the upper and lower layers.

A slot 138 is formed by the gasket body and is adjacent to the bore bridges 126, 106. The slot 138 forms an inlet region 140 and an outlet region 144 connected by a channel 142.

In some examples, the inlet region 140 has a greater depth than that of the channel 142, and multiple upper or lower layers may be removed from the gasket 104 to provide a variable depth.

A perimeter of the inlet region 140 may correspond with a perimeter of the upstream cooling passage 132. A perimeter of the outlet region 144 may also correspond with a perimeter of the downstream cooling passage 154. The channel 142 may have a width corresponding to the respective, adjacent saw cuts 136, 156 in the bore bridges.

In some examples, the gasket 104 has a converging section connecting the inlet region 140 to the channel 142. The gasket may also have a diverging section connecting the channel 142 to the outlet region 144. The perimeter of at least one of the inlet and the outlet regions 140, 144 may be generally triangular, circular, or another shape to correspond with the perimeter of the associated passage. In some examples, the cross sectional area of the inlet and the outlet regions 140, 144 taken along the planar gasket surface corresponds with the cross sectional area of the associated passages taken along the deck face to prevent flow restrictions.

Various embodiments of the present disclosure have associated, non-limiting advantages. The head side and/or block side of the gasket may be slit to provide a slot between adjacent gasket beads. The slot may run from the intake to the exhaust side of the bore bridge, or vice versa. A corresponding saw cut may also be provided in the cylinder head and/or cylinder block to form a cooling passage with the associated slot. By providing a slit in one or more layers of the gasket, an interaction load of a neighboring cylinder may be reduced or eliminated. A bead on the gasket may be allowed to "breath" and increase gasket durability. The slot and associated saw cut may promote pressure driven flow across the deck face and along the bore bridge, either from the intake to exhaust side or vice versa. The coolant flow across the bore bridge reduces head gasket and cylinder head temperatures at the bridge. Additionally, a saw cut in the cylinder head allows the head to expand as temperatures increase during engine operation, thereby reducing stress on the chamber, which in turn may reduce distortion of valve seats. As the valve seats expand due to heating, the saw cut may provide for sufficient load weakening of the bore bridge to allow the valve seat to remain generally round. Without a saw cut and bore bridge cooling, the valve seat may become distorted with heating because of the constrained geometry, i.e. egg shaped, which may reduce durability, valve sealing, and the like. The saw cut may be spaced apart from one of the cooling passages and connected to the other cooling passage to provide structure for the deck face. The depth of the saw cut may vary, and a deeper saw cut provides for additional structural flexibility and reduced valve distortion.

While exemplary embodiments are described above, it is not intended that these embodiments describe all possible forms of the present disclosure. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An internal combustion engine comprising:

a cylinder block defining a block deck face, first and second cylinders, and a block cooling jacket, wherein the first and second cylinders are adjacent to one another and separated by a block bore bridge;

a cylinder head having a head deck face defining first and second chambers, and a head cooling jacket, the first and second chambers adjacent to one another and separated by a head bore bridge, wherein the first chamber and the first cylinder form a first combustion chamber, and the second chamber and the second cylinder form a second combustion chamber; and a head gasket interposed between the cylinder block and the cylinder head, the head gasket having a block side and a head side;

wherein the block cooling jacket has a first passage and a second passage intersecting the block deck face on either side of the block bore bridge;

wherein the head cooling jacket has a third passage and a fourth passage intersecting the head deck face on either side of the head bore bridge;

wherein the deck face of the cylinder head defines a saw cut extending from the fourth passage towards the third passage and is spaced apart from the third passage, the saw cut in the head bore bridge; and wherein the head gasket forms a slot positioned adjacent to at least one of the block bore bridge and head bore bridge and fluidly connecting the first and fourth passages such that coolant flows from the first passage along at least one of the block deck face and head deck face and to the fourth passage to cool the associated bore bridge.

2. The internal combustion engine of claim 1 wherein the head gasket is adapted to cover the second passage and the third passage.

3. The internal combustion engine of claim 1 wherein each of the chambers have an exhaust port opposed to an intake port, wherein the third passage is positioned on an intake port side of the deck face between the first and second chambers, and wherein the fourth passage is positioned on an exhaust side of the deck face between first and second chambers.

4. The internal combustion engine of claim 3 wherein the first passage is positioned on an intake side of the block face between the first and second cylinders, and wherein the second passage is positioned on an exhaust side of the block face between first and second cylinders.

5. The internal combustion engine of claim 1 wherein the block face of the cylinder block defines another saw cut extending from the first passage towards the second passage and spaced apart from the second passage, the another saw cut in the block bore bridge.

6. The internal combustion engine of claim 5 wherein the another saw cut decreases in depth towards the second passage.

7. The internal combustion engine of claim 1 wherein the saw cut continuously increases in depth towards the fourth passage.

8. A head gasket for an engine having a cooling jacket comprising:

a generally planar gasket body having an upper layer for cooperation with a cylinder head deck face, a lower layer for cooperation with a cylinder block deck face, and an intermediate layer positioned between the upper and lower layers, the gasket having formed therein:

a slot formed by the upper, lower, and intermediate layers of the gasket body and adjacent to at least one of a cylinder head bore bridge and a cylinder block bore bridge, the lower layer forming an elongated inlet region of the slot adjacent to an upstream cooling passage in a cylinder block, the upper layer forming an elongated outlet region adjacent to a downstream cooling passage in the cylinder head, and the intermediate layer forming an elongated channel connecting the inlet and outlet regions;

wherein the inlet region and outlet region are spaced apart transversely on the gasket; and wherein the elongated inlet region and elongated outlet region overlap one another.

9. The head gasket of claim 8 wherein the slot is adjacent to the cylinder head bore bridge and the cylinder block bore bridge.

10. The head gasket of claim 8 wherein the slot has a converging section connecting the inlet region to the channel, and a diverging section connecting the channel to the outlet region.

11. The head gasket of claim 8 wherein a perimeter of the inlet region of the slot corresponds with a perimeter of the upstream cooling passage in the cylinder block, a perimeter of the outlet region of the slot corresponds with a perimeter of the downstream cooling passage in the cylinder head; and wherein the channel of the slot has a width corresponding to a saw cut in a bore bridge of the cylinder head.

12. An engine comprising:

a block having a first cooling passage intersecting a block deck face;

a head having a second cooling passage intersecting a head deck, face with a saw cut extending from a bore bridge intermediate region to the second passage and spaced from the first passage; and a head gasket defining a slot extending between and fluidly connecting the first and second passages on opposed sides of the bore bridge between adjacent cylinders.

13. The engine of claim 12 wherein the saw cut continually increases in depth towards the second passage.

14. The engine of claim 12 wherein the block has a third cooling passage intersecting the block deck face and the head has a fourth cooling passage intersecting the head deck face, the third and fourth passages on opposed sides of the bore bridge; and wherein the head gasket covers the third and fourth passages.

15. The engine of claim 12 wherein the block has another saw cut in the block deck face extending from the first passage to the bore bridge intermediate region, the another saw cut spaced apart from the second passage.

16. The engine of claim 12 wherein the slot forms an inclined passage across the gasket.

17. The engine of claim 12 wherein the slot of the head gasket is formed by overlapping elongated slots in each of an upper layer, an intermediate layer, and a lower layer of the head gasket, the elongated slot of the upper layer extending across the second cooling passage and the saw cut to the bore bridge intermediate region.

18. The engine of claim 12 wherein the cylinder block has another saw cut in the block deck face extending from the first passage to the bore bridge intermediate region and spaced from the second passage; and wherein the head gasket further comprises a lower layer forming a first elongated slot extending across the first passage and the another saw cut of the block to the bore bridge intermediate region, an intermediate layer forming a second elongated slot, and an upper layer forming a third elongated slot extending across the second passage and the saw cut of the head to the bore bridge intermediate region, wherein the first, second and third slots overlap and cooperate with one another to form the slot of the head gasket.

* * * * *